US005577455A

United States Patent [19]

Dvorak

[11] Patent Number: 5,577,455

[45] Date of Patent: Nov. 26, 1996

[54] WATERCRAFT PROTECTION MAT

[76] Inventor: Ryan T. Dvorak, 31139 Via Colinas - Suite 201, Westlake Village, Calif. 91362

[21] Appl. No.: 618,167

[22] Filed: Mar. 19, 1996

[51] Int. Cl.[6] ..... B63B 59/02

[52] U.S. Cl. ..... 114/219; 405/1

[58] Field of Search ..... 114/219, 270, 114/343, 221 R, 361; 405/1, 7

[56] References Cited

U.S. PATENT DOCUMENTS

| | | | |
|---|---|---|---|
| 4,803,942 | 2/1989 | Dren | 114/219 |
| 4,815,412 | 3/1989 | Cassaro | 114/343 |
| 4,962,719 | 10/1990 | Hughes, Jr. | 114/343 |
| 5,357,890 | 10/1994 | Mason | 114/219 |
| 5,398,631 | 3/1995 | Miller | 114/219 |
| 5,454,341 | 10/1995 | Bensley et al. | 114/343 |

*Primary Examiner*—Edwin L. Swinehart
*Attorney, Agent, or Firm*—Jack C. Munro

[57] ABSTRACT

A watercraft protection mat that is to be placed at the shoreline prior to beaching of a watercraft. The watercraft, when being beached, is to have its hull to be maneuvered onto the mat. The mat is to include appropriate openings to facilitate its connection with a plurality of fasteners that function as a tie down arrangement to secure the mat in position at the shoreline. The heads of the fasteners are to be covered by a covering flap when the mat is in use. The mat is to include appropriate weights so that it will sink within the water. The weights are each to include loose particulate matter that will conform to irregular shapes located at the shore insuring that the mat will rest evenly on the shore. The mat also includes elongated rigid members which function as stiffeners to keep the mat from bunching up, thereby retaining its established position. The mat is to be constructed of a plurality of layers with there being a cushiony layer located in between a top layer and a bottom layer.

9 Claims, 2 Drawing Sheets

WATERCRAFT PROTECTION MAT

BACKGROUND OF THE INVENTION

1) Field of the Invention

The field of this invention relates to boating equipment and more particularly to a mat that is to be placed at the shoreline prior to the moving of the hull of a watercraft onto the shoreline.

2) Description of the Prior Art

In boating, beaching of a watercraft such as a boat or jet ski is exceedingly common. Beaching is defined as moving of the watercraft on shore by bringing the bow of the watercraft up on the shore out of the water while the remainder of the watercraft stays in the water. Beaching can provide a mooring for an extensive period of time or can be used for the purpose of dropping off or picking up of passengers and/or supplies. This type of mooring procedure almost invariably causes damage to the hull in varying degrees. After repeated beachings, repair and refinishing of the hull is required.

Additionally, many watercraft are driven by an impeller propulsion system. This system pulls water through an opening at the bottom of the watercraft. An impeller, which is very similar to a propeller, forces the water through an exit tube with sufficient energy so as to propel the craft in a forward direction. The impeller system is very susceptible to damage by ingested gravel, sand, rocks or other debris commonly found on the shoreline. This debris can be sucked into the propulsion system by the impeller. This debris can cause damage to the impeller, and in some instances destroy the impeller completely. Replacing of the impeller is a rather expensive procedure.

There have been previous attempts to construct devices to protect the hull of boats and jet skis. One type of prior device is a tarp that is placed around the bow of the watercraft. One of the disadvantages to such a device is that installation can be difficult and is normally usable only with small watercraft. Another device that is similar to this invention is a mat that is to be placed on the shore at the shoreline. These prior art mats have not been securely fastened to the shore which makes the mat susceptible to movement when contacted by the watercraft. This movement of the mat might position the mat in a non-protecting location. Also, the mats of the prior art are susceptible to movement by wind or water currents which again would locate the mat in a non-protecting position. Also, mats of the prior art have made no attempts at hiding the mat fastening devices to insure that such do not contact the hull of the watercraft and cause damage. Also, no prior art mats have included any type of mat stiffening devices to prevent "bunching up" of the mat when being mounted by a watercraft which can locate the mat in a non-protecting position.

It also has been known within prior art mats to include some type of weight to insure that most of the mat will rest below the surface of the water at the shoreline. These weights have been solid members which can cause damage to the watercraft. Also, solid weights do not conform to the irregular shape of the shoreline so a part of the mat may be positioned a slight distance off the shore which might result in the watercraft pushing the mat out of position and in a non-protecting location.

SUMMARY OF THE INVENTION

One of the primary objectives of the present invention is to provide a mat that can be placed at the shoreline prior to beaching of the watercraft so as to thereby eliminate the possibility of damage to the hull and minimize damage to the impeller propulsion system of the watercraft.

The mat of this invention has a body which is formed of thin sheet material with this body being capable of being rolled up similar to a section of fabric. Typically, the material of construction for the body would be of heavy nylon or canvas material. The shape of the body is rectangular, although it is envisioned that other shapes for the body could be utilized. Directly adjacent the forward edge of the body there is incorporated a plurality of holes with at least two of the holes to be separately connectable with an elongated fastener that are to be used to penetrate the shoreline. The heads of these fasteners are to be covered by a flap to insure that these fasteners do not damage the hull of the watercraft. Except for the forward edge of the body, the body is to be located beneath the water at the shoreline. The body is to include a plurality of pockets of weight so as to keep the body located against the bottom of the shore and prevent floating of the body. The weight is to comprise loose particulate material such as stainless steel shot or coarse sand. Also, when the hull of the watercraft is brought up against the body, it is desirable to keep the body from "bunching up. " In order to prevent this bunching up, the body includes a plurality of elongated rigid rods which function as stiffeners and force the body to keep its original shape. Between the top layer of the body and the bottom layer of the body there is to be located a cushiony material which is to cushion the hull of the watercraft as it is moved onto the body.

DETAILED DESCRIPTION OF THE PREFERRED EMBODIMENT

Figure 1:
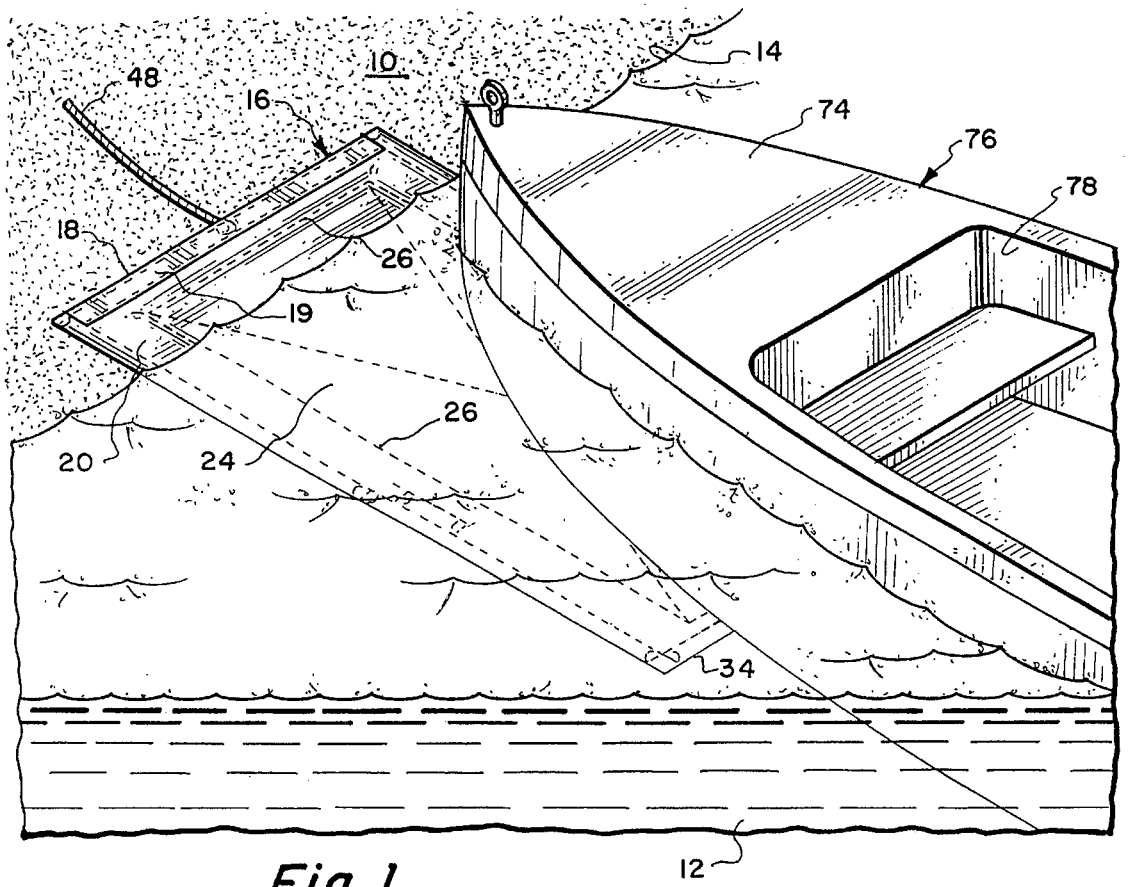
FIG. 1 is an isometric view showing installation of the watercraft protection mat of this invention, in conjunction with the shoreline and depicting a hull of a watercraft being moved there upon.

Referring particularly to the drawings there is shown in FIG. 1 a beach 10 which is to be contacted by water 12 forming a water line 14. The watercraft protection mat 16 of this invention is to be placed so that the forward edge 18 is located on the beach 10 with the majority of the mat 16 being located within the water 12. The mat 16 is shown rectangular and has a width of approximately three feet with a length of approximately seven feet. It is within the scope of this invention that other configurations for the mat 16 could be utilized such as an oblong shape, a triangular shape and possibly even a round shape.

The mat 16 is composed of a top layer 20 and a bottom layer 22. Typical material of construction for the top layer 20 would be a heavy nylon or canvas material with the exterior surface of the top layer 20 being roughened so as to constitute a non-slip surface. Upon a human stepping on the mat 16 it would be desirable to not have the human slip. The bottom layer 22 will normally be constructed of a rubberized or plastic puncture resistant material, and might comprise a rubberized nylon or rot resistant canvas. Normally the surface of the bottom layer 22 will be smooth.

Figure 2:
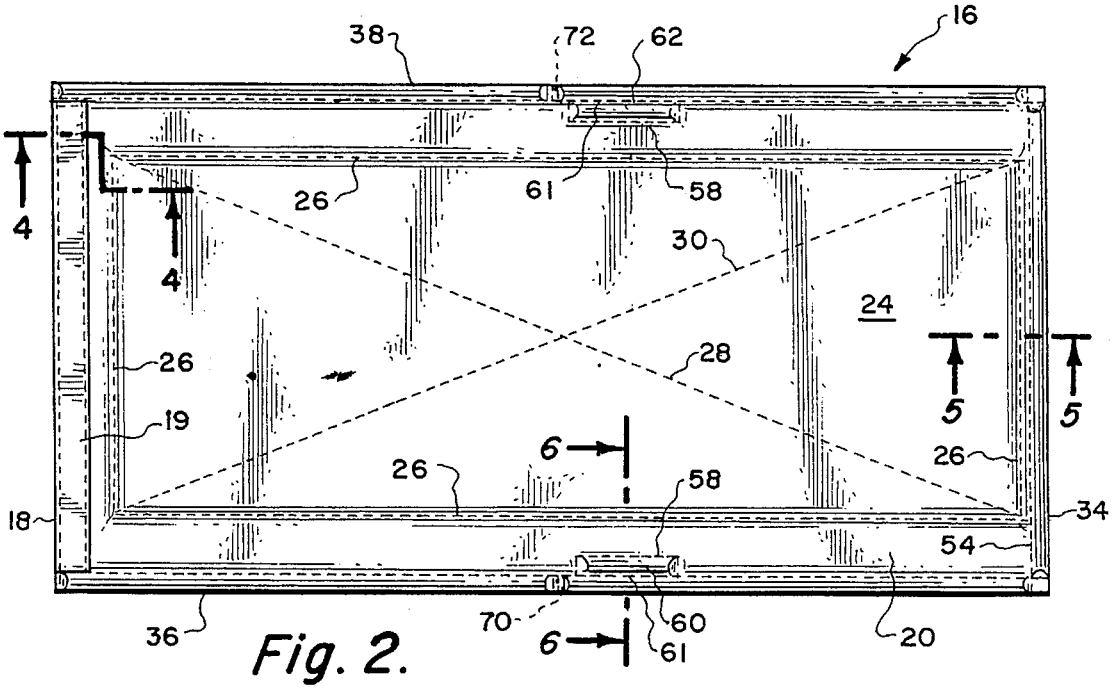
FIG. 2 is a top plan view of the watercraft protection mat of this invention.
Figure 3:
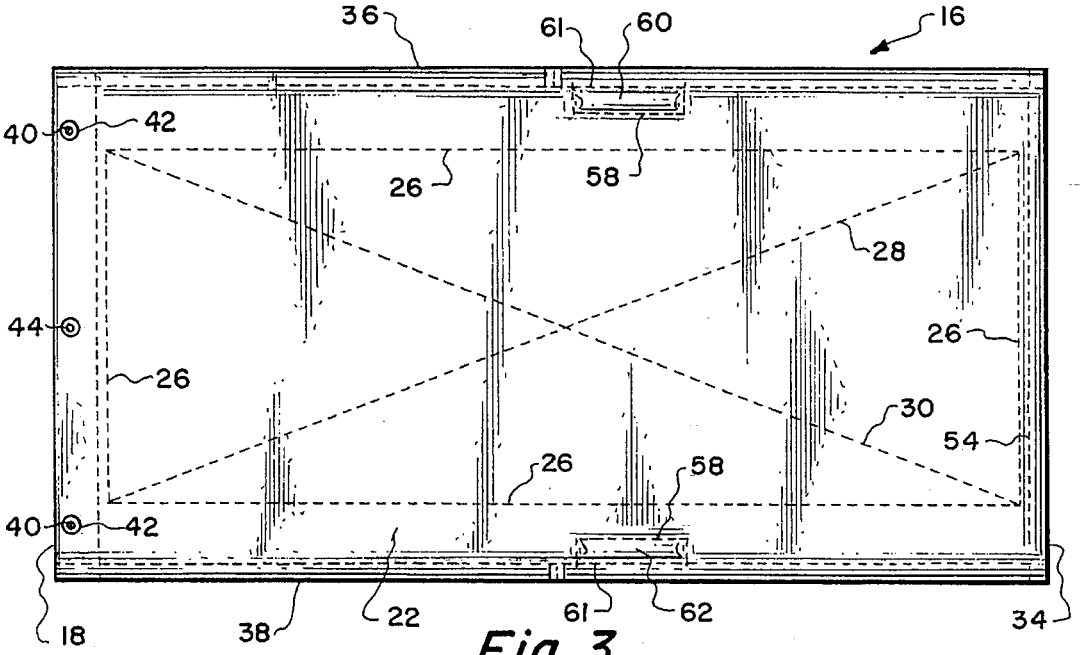
FIG. 3 is a bottom plan view of the watercraft protection mat of this invention.
Figure 4:
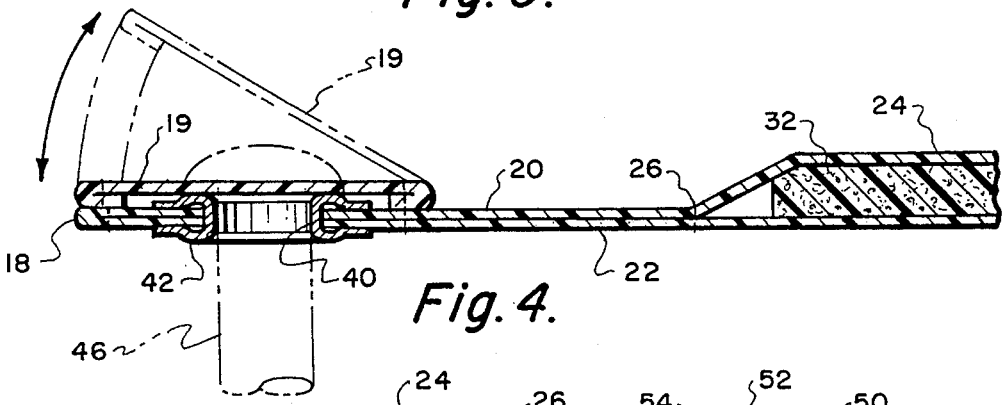
FIG. 4 is a cross-sectional view taken along line 4—4 of FIG. 2.
Figure 5:
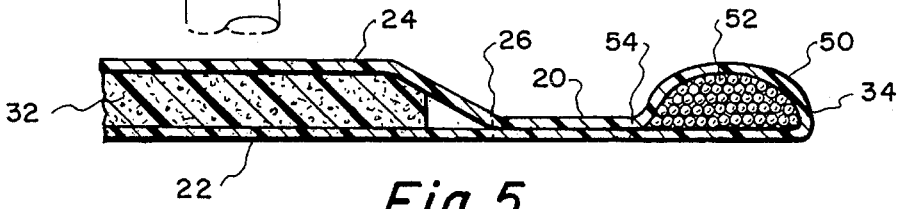
FIG. 5 is a cross-sectional view taken along line 5—5 of FIG. 2.
Figure 6:
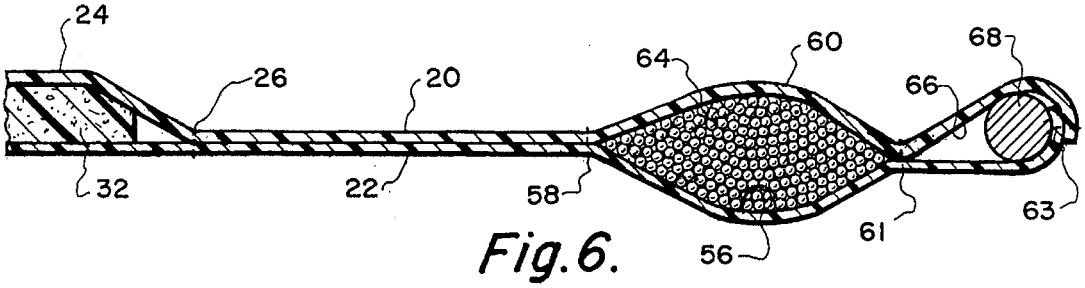
FIG. 6 is a cross-sectional view taken along line 6—6 of FIG. 2.

Referring particularly to FIGS. 2 and 3 of the drawings, there is shown a center section 24 which is enclosed by rectangular shaped dotted lines 26. The dotted lines 26 represent stitching which connects center section 24 and the top layer 20 to the bottom layer 22. Also extending across the center section 24 are cross stitches 28 and 30. Located within this center section 24 is a cushiony material in the form of a thin high density foam 32. It is considered to be within the scope of this invention that other cushiony materials could be utilized. It is important that the mat 16 be constructed of a water resistant material. This would include the foam 32. It is desirable that the mat 16 not retain water when it is disassembled and collapsed. It is important to have the mat 16 be as light in weight as possible in order to facilitate its portability. It is also important that when the mat 16 is collapsed and rolled up that it occupy as little space as possible since space often is at a premium on watercraft.

The mat 16 has a rearward edge 34 which is located parallel to and opposite the forward edge 18. In between the forward edge 18 and the rearward edge 34 are a left side edge 36 and a right side edge 38. Formed within the body of the mat 16 and located directly adjacent the forward edge 18 is a pair of eyelets 40 with one eyelet 40 located directly adjacent the left side edge 36 and the other eyelet 40 located directly adjacent the right side edge 38. The eyelets 40 are formed by a grommet 42. The grommet 42 is secured within the top layer 20 and the bottom layer 22. Centrally located between the eyelets 40 is a center eyelet 44. The center eyelet 44 is basically identical to the eyelet 40 and is also enclosed by grommet 42.

An elongated fastener 46 is to connect with each of the eyelets 40. Normally the fastener 46 will be about six to eight inches in length and have an enlarged head. The fastener 46 is to penetrate the shore 10 with the head of each of the fasteners abutting against the grommet 42 for its respective eyelet 40. It is the purpose of the fasteners 46 to fix in position the mat 16 on the shore 10.

It is desirable to cover the heads of the fasteners 46 to insure that such are not able to contact the hull 74 of the watercraft 76. In order to do this there is incorporated a flap 19 which is sewn into the body of the mat 16. The flap 19 is to be manually deflected to gain access to the heads of the fasteners 46 for installing and removing the fasteners 46. If per chance the hull 74 of the watercraft 76 comes to rest in the area of the fasteners 46, the flap 19 will protect the hull 74 from damage by the heads of the fasteners 46.

The function of the eyelet 44 is to connect with a tie down line 48 which is to be connected to some form of anchoring device (not shown) which is to be inserted into the shore 10. The anchoring device will be spaced some distance from the shoreline and also some distance from the fasteners 46. The purpose of this tie down line 48 is that if in the event the fasteners 46 become dislodged due to heavy seas, the tie down device will keep the mat 16 from floating away.

Mounted between the top layer 20 and the bottom layer 22 and located directly adjacent the rearward edge 34 is an elongated pocket 50. The elongated pocket 50 extends from the left side edge 36 to the right side edge 38. Within the elongated pocket 50 is located a quantity of a weight in the form of stainless steel shot 52. The elongated pocket 50 is formed by stitching 54 between the top layer 20 and the bottom layer 22. The stainless steel shot 52 prevents the current from pushing water under the mat 16 and dislodging it.

Directly adjacent the left side edge 36 and located in between the forward edge 18 and the rearward edge 34 is a short pocket 56. The short pocket 56 is formed by stitches 58 and 62 and is located between the top layer 20 and the bottom layer 22. The short pocket 56 forms a short bulbous section 60. It is to be understood that there will be a similar short bulbous section 62 located directly adjacent to the right side edge 38. Located in and completely filling the short pocket 56 is a quantity of stainless steel shot 64. There will similarly be located stainless steel shot (not shown) within the short bulbous section 62.

It is important that a loose weight material be used so the portion of the mat 16 in the area of the elongated pocket 50 and short bulbous sections 60 and 62 can just deform around any protruding object (such as a rock) located within the water at the shoreline. Although stainless steel shot 64 is preferred, other loose weighted material could be used such as sand, Alongside of the left side edge 36 there is an elongated pocket 66. A similar elongated pocket (not shown) is located along the right side edge 38. The outside edge of pocket 66 is closed by stitching 63 attaching top layer 20 to bottom layer 22. Within the pocket 66 is placed a pair of stiffeners in the form of rigid but bendable rods 68 with only one such rod 68 being shown. Each rod 68 is just short of three feet in length and is of the same diameter. The rods 68 could comprise a durable yet bendable material such as a nylon or plastic. The rods 68 are located in an in-line manner within the pocket 66 forming a slight gap 70 there between. It is to be understood that there will be a similar arrangement of rods located within the pocket directly adjacent the right side edge 38 forming a gap 72. It is the function of the rods 68 to keep the mat 16 from bunching up on itself as the hull 74 of the watercraft 76 is dragged up the mat 16 even when there is a strong water current or a strong wind.

When it is desired to remove the mat 16 and place such into storage within the cabin area 78 of the watercraft 76, the user only needs to disengage the fasteners 46 and the tie down rope 48. It is to be understood that the tie down rope 48 will be connected to a fastener (not shown) similar to fastener 46 which is located within the eyelet 44. Mat 16 can then be removed from the water 12 with any excess water to be shaken off the mat 16. The mat 16 is then folded in half with the fold line occurring across the gaps 70 and 72. The mat 16 is then to be rolled up from the left side edge 36 to the right side edge 38. This rolling up of the mat 16 will cause the mat 16 to be confined within a small amount of space to facilitate its storage within any watercraft 76.

It is also to be noted that the cushiony center section 24 is spaced some distance from the side edges 36 and 38. It is generally only necessary for the cushiony area to be located within a center strip of the mat 16 since it is only the center strip that is actually going to come into contact with the hull 74 of the watercraft 76. It is to be understood that there are actually four in number of the rods 68. It is desirable for the weights to take the form of shot rather than a solid rigid member so as to not hinder the rolling up procedure when not in use and to conform to the shoreline and the hull of the watercraft when in use.

What is claimed is:

1. A watercraft protection mat comprising:

a thin sheet material body having a forward edge and a rearward edge with a left side edge and a right side edge located there between, said body being constructed of a bottom layer and a top layer;

a plurality of eyelets located in said body directly adjacent said forward edge, at least one of said eyelets to receive an elongated fastener, said fastener for penetrating a supporting surface on which said body has been placed;

a flap attached to said body, said flap being movable between a closed position and an open position, said open position exposing said plurality of eyelets permitting access to said elongated fastener, said closed position covering said elongated fastener and said plurality of eyelets;

weight means mounted on said body, a portion of said weight means being located directly adjacent said rearward edge; and stiffener means mounted on said body, said stiffener means comprising a first elongated rigid member attached to said body and located directly adjacent said left side edge and a second elongated rigid member attached to said body and located directly adjacent said right side edge, whereby said body is to be located at the shoreline and the hull of the watercraft is to be moved onto said body thereby preventing damage to the hull of the watercraft and damage to the watercraft propulsion system from natural material and debris located at the shoreline.

2. The watercraft protection mat as defined in claim 1 wherein:

a cushiony layer located between said top layer and said bottom layer, said cushiony layer to be located between the hull of the watercraft and the shoreline.

3. The watercraft protection mat as defined in claim 2 wherein:

said cushiony layer comprising plastic foam.

4. The watercraft protection mat as defined in claim 1 wherein:

there being a plurality of said elongated fasteners with there being a separate said elongated rigid fastener for each said eyelet.

5. The watercraft protection mat as defined in claim 1 wherein:

said weight means being located between said bottom layer and said top layer, said weight means comprising a quantity of loose particulate matter.

6. The watercraft protection mat as defined in claim 1 wherein:

a portion of said weight means being located directly adjacent said left side edge, a portion of said weight means being located directly adjacent said right side edge.

7. The watercraft protection mat as defined in claim 1 wherein:

there being a third elongated rigid member and a fourth elongated rigid member, said third elongated rigid member to be located directly adjacent said left side edge and said fourth elongated rigid member to be located directly adjacent said right side edge, said first elongated rigid member being in line with said third elongated rigid member, said second elongated rigid member being in line with said fourth elongated rigid member, there being a first gap area located between said first and third elongated rigid members, there being a second gap area located between said second and fourth elongated rigid members, said body capable of being folded over onto itself with the fold line extending between said first gap area and said second gap area.

8. The watercraft protection mat as defined in claim 1 wherein:

said plurality of eyelets including a free hole that is not to be connected to a said elongated fastener, said free hole adapted to be connected to a safety line to insure that said body will not be washed away by the surf at said shoreline.

9. The watercraft protection mat as defined in claim 1 wherein:

said top layer having a roughened surface to thereby function as a non-slip surface, said bottom surface having a smooth surface.

* * * * *